US008130993B2

(12) United States Patent
Ho et al.

(10) Patent No.: US 8,130,993 B2
(45) Date of Patent: Mar. 6, 2012

(54) HEARING DEVICE WITH A SECURING SYSTEM FOR A RECEIVER TUBE

(75) Inventors: Wai Kit David Ho, Singapore (SG); Wee Haw Koo, Singapore (SG); Beng Hai Tan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 939 days.

(21) Appl. No.: 12/075,722

(22) Filed: Mar. 13, 2008

(65) Prior Publication Data

US 2008/0232628 A1 Sep. 25, 2008

(30) Foreign Application Priority Data

Mar. 23, 2007 (DE) ..... 10 2007 014 131

(51) Int. Cl.
*H04R 25/00* (2006.01)

(52) U.S. Cl. ..... 381/330

(58) Field of Classification Search ..... 381/381, 381/375, 186, 330, 322, 324; 181/130, 135
See application file for complete search history.

(56) References Cited

U.S. PATENT DOCUMENTS

| | | | | |
|---|---|---|---|---|
| 3,783,864 | A | 1/1974 | Moller | |
| 4,440,982 | A * | 4/1984 | Kaanders et al. | 381/322 |
| 5,002,151 | A * | 3/1991 | Oliveira et al. | 181/130 |
| 5,099,947 | A | 3/1992 | Guggenberger et al. | |
| 5,278,360 | A * | 1/1994 | Carbe et al. | 181/135 |
| 5,404,105 | A | 4/1995 | Chari | |
| 5,753,870 | A | 5/1998 | Schlaegel et al. | |
| 5,864,628 | A | 1/1999 | Posen et al. | |
| 6,493,453 | B1 | 12/2002 | Glendon | |
| 7,424,123 | B2 * | 9/2008 | Shennib et al. | 381/328 |
| 7,522,743 | B2 * | 4/2009 | Dobras et al. | 381/381 |
| 7,715,580 | B2 * | 5/2010 | Nielsen | 381/322 |
| 2004/0264723 | A1 | 12/2004 | Saltykov | |
| 2005/0074138 | A1 | 4/2005 | Saltykov | |

(Continued)

FOREIGN PATENT DOCUMENTS

DE 20108827 U1 10/2001

(Continued)

OTHER PUBLICATIONS

US Invention Disclosure citing references, Feb. 15, 2006, pp. 1-6.

*Primary Examiner* — Davetta W Goins
*Assistant Examiner* — Phan Le

(57) ABSTRACT

The invention relates to a securing system for a receiver tube in a hearing device. The object of the invention is to provide a securing system for the receiver tube in a hearing device, which reliably prevents the occurrence of disruptive acoustic feedback and does not require adhesive to secure the receiver tube. This object of the invention is achieved with a hearing device, in particular a BTE hearing device, in which a receiver facility is disposed, wherein the hearing device has a connector piece, which is connected to the receiver facility by way of a receiver tube, in order to conduct an acoustic signal or acoustic signals generated by the receiver facility to an acoustic output of the hearing device, with the receiver tube being provided with a connecting element, which connects the receiver tube and the connector piece to each other in an essentially acoustically sealed manner.

16 Claims, 5 Drawing Sheets

U.S. PATENT DOCUMENTS

2007/0092094 A1* 4/2007 Gilbertson ..... 381/328

FOREIGN PATENT DOCUMENTS

| | | | |
|---|---|---|---|
| EP | 0724377 | A1 | 7/1996 |
| EP | 1443802 | A2 | 8/2004 |
| EP | 1571882 | A2 | 9/2005 |
| JP | 07222291 | A | 8/1995 |
| KR | 20040016345 | A | 2/2004 |
| NL | 1000878 | C2 | 1/1997 |
| NL | 1000880 | C2 | 1/1997 |
| WO | 9105446 | A1 | 4/1991 |
| WO | 2005051040 | A1 | 6/2005 |

* cited by examiner

HEARING DEVICE WITH A SECURING SYSTEM FOR A RECEIVER TUBE

CROSS REFERENCE TO RELATED APPLICATIONS

This application claims priority of German application No. 10 2007 014 131.0 filed Mar. 23, 2007, which is incorporated by reference herein in its entirety.

FIELD OF THE INVENTION

The invention relates to the securing system for a receiver tube in a hearing device.

BACKGROUND OF THE INVENTION

Hearing devices generally have a housing, in which a microphone, an amplifier facility, a receiver and an energy supply facility are disposed. A receiver tube connects the receiver to the acoustic output or sound outlet of the housing, to conduct the acoustic signals generated by the receiver. In the case of a behind-the-ear (BTE) hearing device, the housing is connected by way of a connector piece to a carrier hook, which has a sound channel. The acoustic signal generated by the receiver is hereby transmitted to the ear by way of the receiver tube, the housing connector piece and the sound channel.

A hearing device is known from EP 1 443 802, with a tubular connector element to connect the output to a tube for sound transmission into the ear canal. The internal diameter of the acoustic transmission channel in the connector element corresponds roughly to the external diameter of the tube, so that the latter can be inserted into this acoustic transmission channel. The tube is guided into the connector element and disposed there in a secure manner, for example by bonding, welding, slip-resistant configuration of the boundary surface between the tube and connector element, etc.

It is known from the prior art that acoustic feedback can result if the securing system for the receiver tube is not sealed. Some of the acoustic signal generated by the receiver then escapes from the receiver tube by way of the unsealed securing system, passing into the interior of the housing. The acoustic signal is picked up there by way of the microphone and converted to an electrical signal. The weak electrical signal is then amplified in the amplifier facility and forwarded to the receiver. The receiver converts the electrical signal back to an acoustic signal. This produces acoustic feedback, which the hearing device wearer may perceive as an unpleasant whistle.

Elderly people frequently experience a deterioration in their perception of high frequencies, which makes it difficult to understand spoken speech. Therefore acoustic signals in the high-frequency range principally are processed and amplified by the hearing device. With the unsealed securing system described above therefore acoustic signals in the high-frequency range predominantly escape into the interior of the housing and cause acoustic feedback.

To prevent acoustic feedback, attempts have therefore been made to date to connect the receiver tube and housing connector piece to each other in the most airtight and/or acoustically sealed manner possible. This is intended to prevent the passage of sound and/or acoustic signals through the connection.

It has however proven that a receiver tube made of a rubber material and a connector piece made of metal or a metal alloy cannot be connected to each other in a sealed manner easily.

It is therefore generally known from the prior art that the receiver tube can be secured using an adhesive, for example Loctite, Crotoflex or Uhu Plus, to a corresponding receiver connector section and/or a housing connector piece, thereby sealing it.

However this has various disadvantages. For example an additional securing step using adhesive is required.

Also if the hearing device is dropped, the receiver tube can come loose or become detached from its securing system, which in turn results in a lack of seal for the securing system and the associated disadvantages of acoustic feedback.

A further disadvantage is that the manufacturing tolerances for the receiver tube and the corresponding connector piece are relatively small, to ensure an essentially sealed connection. Also when the receiver tube is secured with adhesive, it cannot easily be removed for cleaning purposes.

Also over time the adhesive becomes brittle and cracked and no longer provides a seal. A further disadvantage is that parts, such as the receiver and microphone for example, can be damaged by adhesive thinners.

SUMMARY OF THE INVENTION

The object of the invention is therefore to provide a securing system for the receiver tube in a hearing device, which reliably prevents the occurrence of acoustic feedback and does not require adhesive to secure the receiver tube.

According to the invention this object is achieved in that the receiver tube and connector piece are connected to each other in an essentially sealed manner by way of a connecting element or connecting sleeve.

This has the advantage that no adhesive is required for securing and sealing purposes. It is also possible to compensate for larger manufacturing tolerances. In contrast, when adhesive is used, the receiver tube and connector piece must be manufactured very precisely, so that the adhesive can seal the connection between the two parts adequately.

In a preferred embodiment of the invention the receiver tube is also molded onto the connecting element, for example using injection molding methods. This has the advantage that the tube can be attached securely and in an essentially sealed manner to the connecting element. A further advantage is that, even if the hearing device is dropped, the receiver tube cannot come loose or become detached. This allows the occurrence of acoustic feedback to be reliably prevented.

In one inventive embodiment the connecting element is embodied as a separate part, which can be disposed on the receiver tube in a freely movable manner. This has the advantage that it can be produced at low cost. p In a further embodiment of the invention the receiver tube and connecting element are preferably embodied respectively with a flanged section. This has the advantage that when the receiver tube is secured, its flanged section abuts against that of the connecting element, thereby forming a seal.

Accordingly a seal is formed between the receiver tube and the connector piece. This can additionally improve the seal of the securing system and prevent the occurrence of acoustic feedback in an essentially complete manner.

In a further embodiment the connecting element and the connector piece are provided respectively with a threaded section, so that the receiver tube can be screwed to the connector piece by way of the connecting element. This has the advantage that the receiver tube can be attached securely to the connector piece, so that it is unable to come loose or become detached in an unwanted manner, if the hearing device is dropped. Also the receiver tube can be easily removed for cleaning. In contrast, in the case of an adhesive connection, the tube must first be carefully detached from its securing system and then bonded back in again later.

Further advantages of the inventive hearing device and its securing system are that it has been possible to reduce research and development cycles significantly, since acoustic sealing poses fewer or no more problems with the inventive securing system. Also assembly times can be reduced by the inventive securing system and process quality improved. In particular it has been possible to improve the so-called first pass yield, in other words the percentage of results that are already correct in the first process pass and require no remedial action. It has also been possible to improve stability and amplification at high frequencies.

BRIEF DESCRIPTION OF THE DRAWINGS

The invention is described in more detail based on two embodiments in the accompanying drawings, in which.

DETAILED DESCRIPTION OF THE INVENTION

Figure 1:
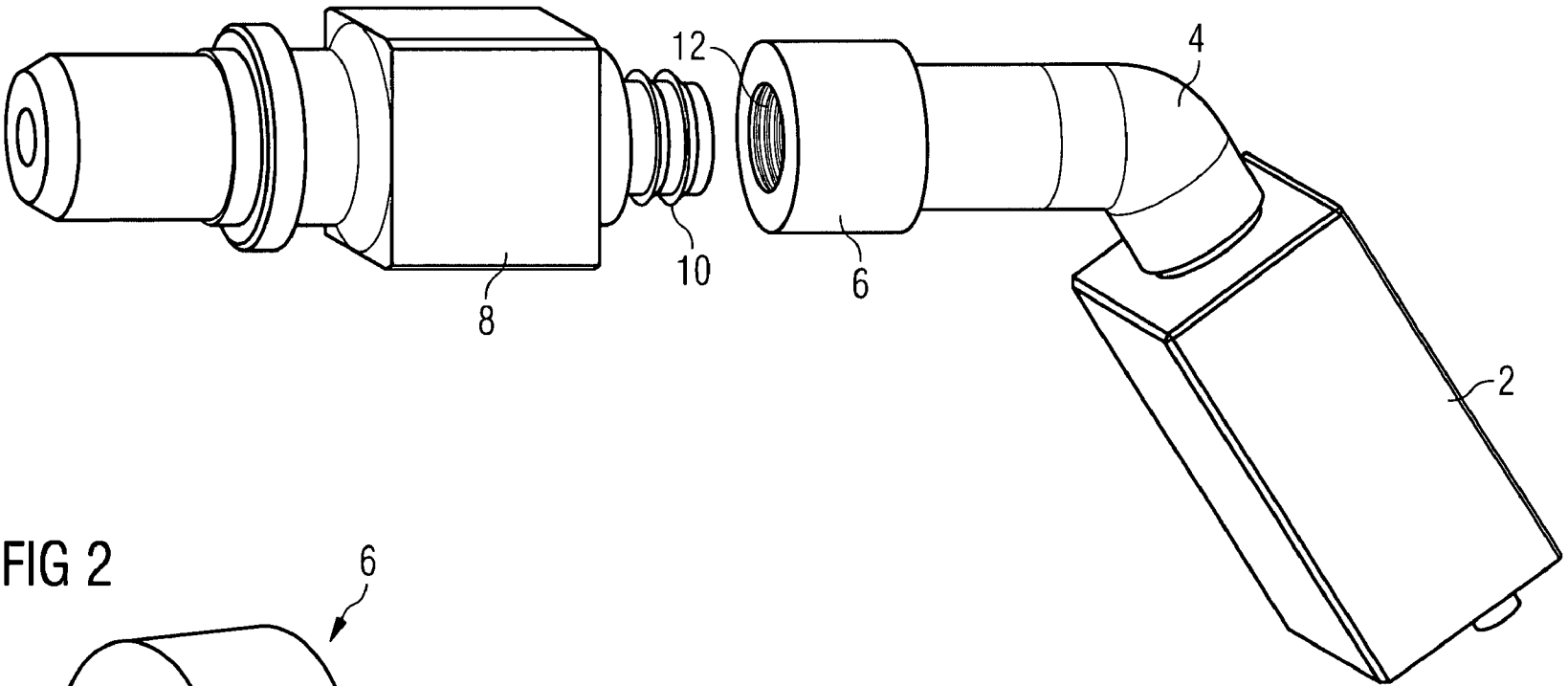
FIG. 1 shows a first inventive embodiment of a securing system for a receiver tube.

According to a first embodiment of the invention, as shown in FIG. 1, a hearing device has a receiver facility 2, which is connected to a receiver tube 4. The receiver tube 4 preferably consists of a flexible material, for example a rubber material, fluorosilicone or Viton, to dampen oscillations of the receiver 2.

The front end of the receiver tube 4 is connected to a connecting element 6. The connecting element 6 here is molded to or on the receiver tube 4, for example using an injection molding method, such as insert molding for example.

Figure 3:
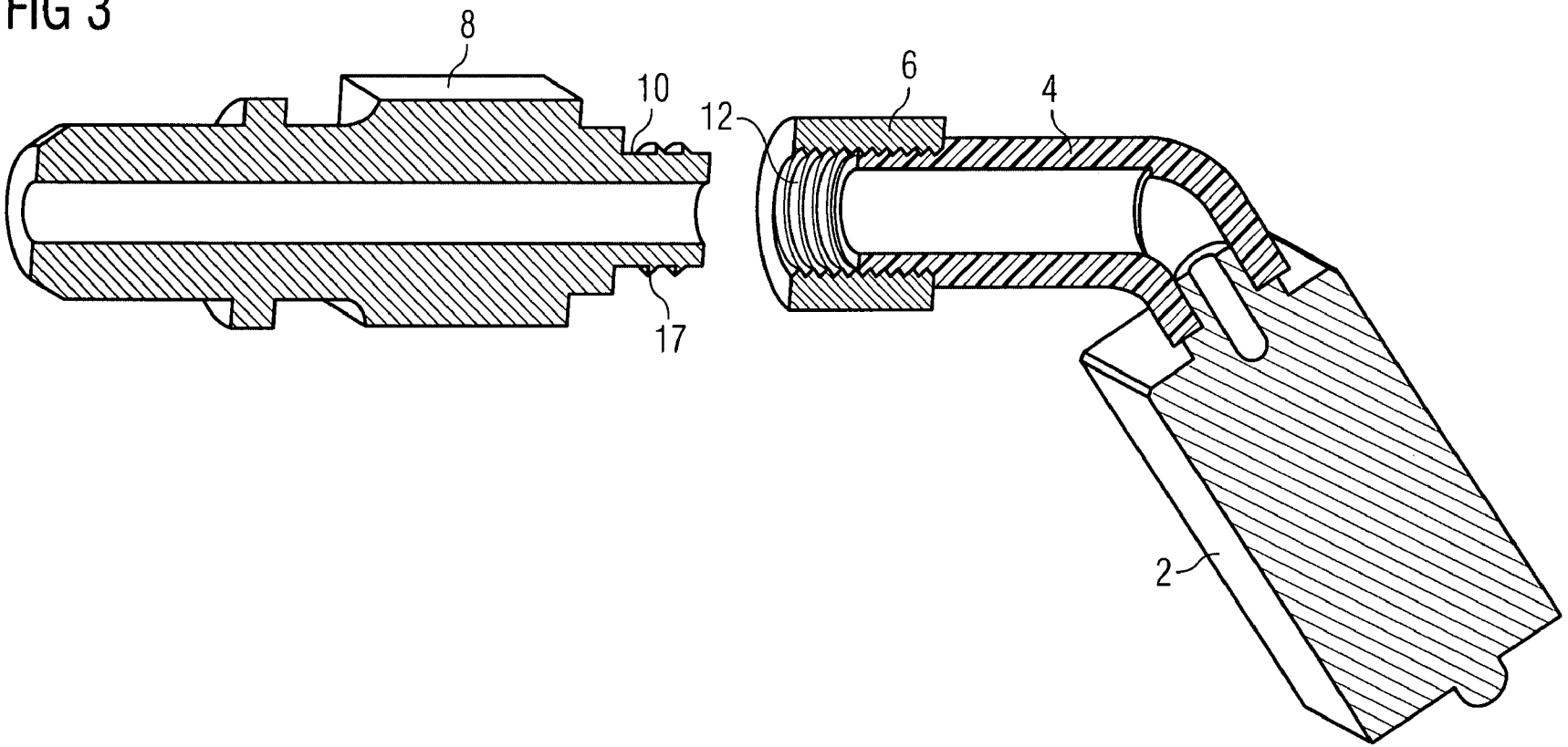
FIG. 3 shows a cross-sectional view of the embodiment in FIG. 1.

The connecting element 6 can be provided with a threaded section 12, as shown in FIG. 3. However the connecting element 6 can also be provided with at least one recess and/or groove or a projection and/or flange, to which the receiver tube 4 is molded. The recess or projection here can be embodied in a continuous or at least partially continuous manner. Provision of such a recess or projection and/or groove or flange has the advantage that the grip between the receiver tube 4 and the connecting element 6 is further strengthened.

The connecting element 6 with the receiver tube 4 secured thereto is then screwed to a connector piece 8. To this end the connector piece 8 has a corresponding thread 17 and is screwed into the connecting element 6, until it preferably abuts against the end of the receiver tube 4 or pushes and/or presses against this. This has the advantage that an additional seal can be produced between the connector piece 8 and the receiver tube 4, further improving the seal of the securing system. In particular a connection that is essentially acoustically sealed up to 100% can be achieved.

Acoustically sealed connection here means that essentially no acoustic signal or sound can escape from the receiver tube 4 by way of the securing system to the connector piece 8.

The connector piece 8 serves, as shown in FIGS. 1, 3, 4 and 5, to connect a carrier hook (not shown) of a behind the ear (BTE) hearing device to a hearing device housing (not shown). In addition to the connector piece 8 for a BTE hearing device it is also possible to secure the receiver tube 4 to the connecting element 6 using a correspondingly molded connector piece 8 in the housing of an ITE hearing device, to connect the receiver facility 2 to the acoustic output of the ITE hearing device by way of the receiver tube 4.

The connector piece 8 and the connecting element 6 can be made of plastic, for example a hard plastic material, such as hard rubber and/or a metal or a metal alloy. Metal has the advantage that the inherent weight of the connector piece 8 means that essentially no vibrations are transmitted to the carrier hook. The connector piece 8 can be embodied in any manner, for example with a thread, in order to be connected to the carrier hook.

In alternative embodiments the receiver tube 4 can also be attached or molded to the outer periphery of the connecting element 6 (not shown) instead of to the inner periphery of the connecting element 6, as shown in FIGS. 1 and 3. The outer periphery of the connecting element 6 can then be provided for example with at least one threaded section and optionally also with at least one groove and/or flange, as described above with reference to the inner periphery.

With these inventive embodiments the connecting element 6 can be provided preferably with a corresponding external thread instead of an internal thread, to which external thread the connector piece 8 is screwed. In this process the connector piece 8, as described above, is screwed onto the connecting element 6, until it abuts against the receiver tube 4 or pushes and/or presses against it. This allows a seal to be produced.

In a further embodiment of the invention, as shown in FIGS. 4 to 7, the connecting element 6 is embodied as a separate part, which is pushed onto the receiver tube 4. The connecting element 6 and the connector piece 8 respectively preferably have a threaded section 12 and/or 17, so that they can be screwed to each other.

Figure 4:
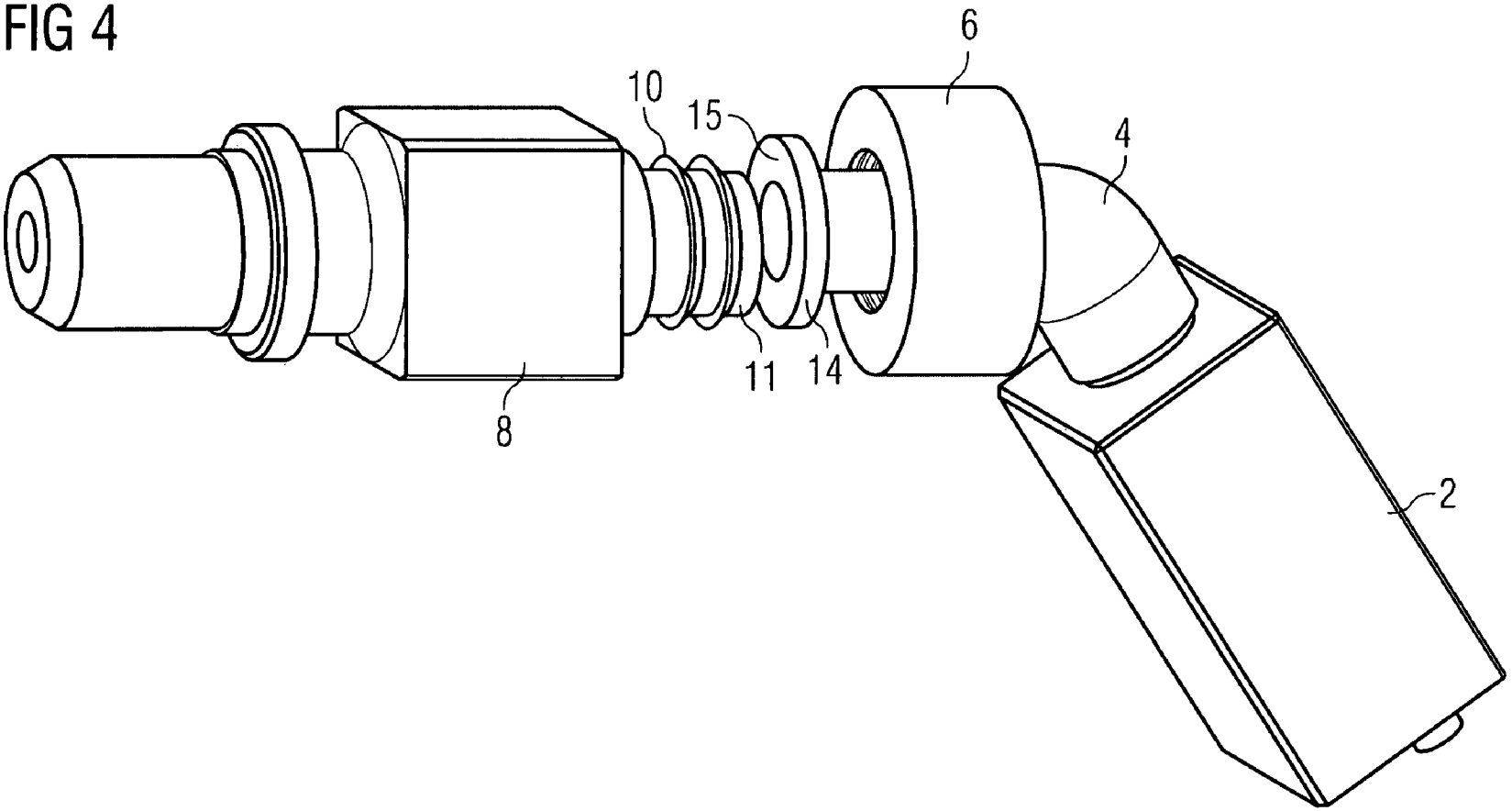
FIG. 4 shows a second inventive embodiment of the securing system for the receiver tube.
Figure 5:
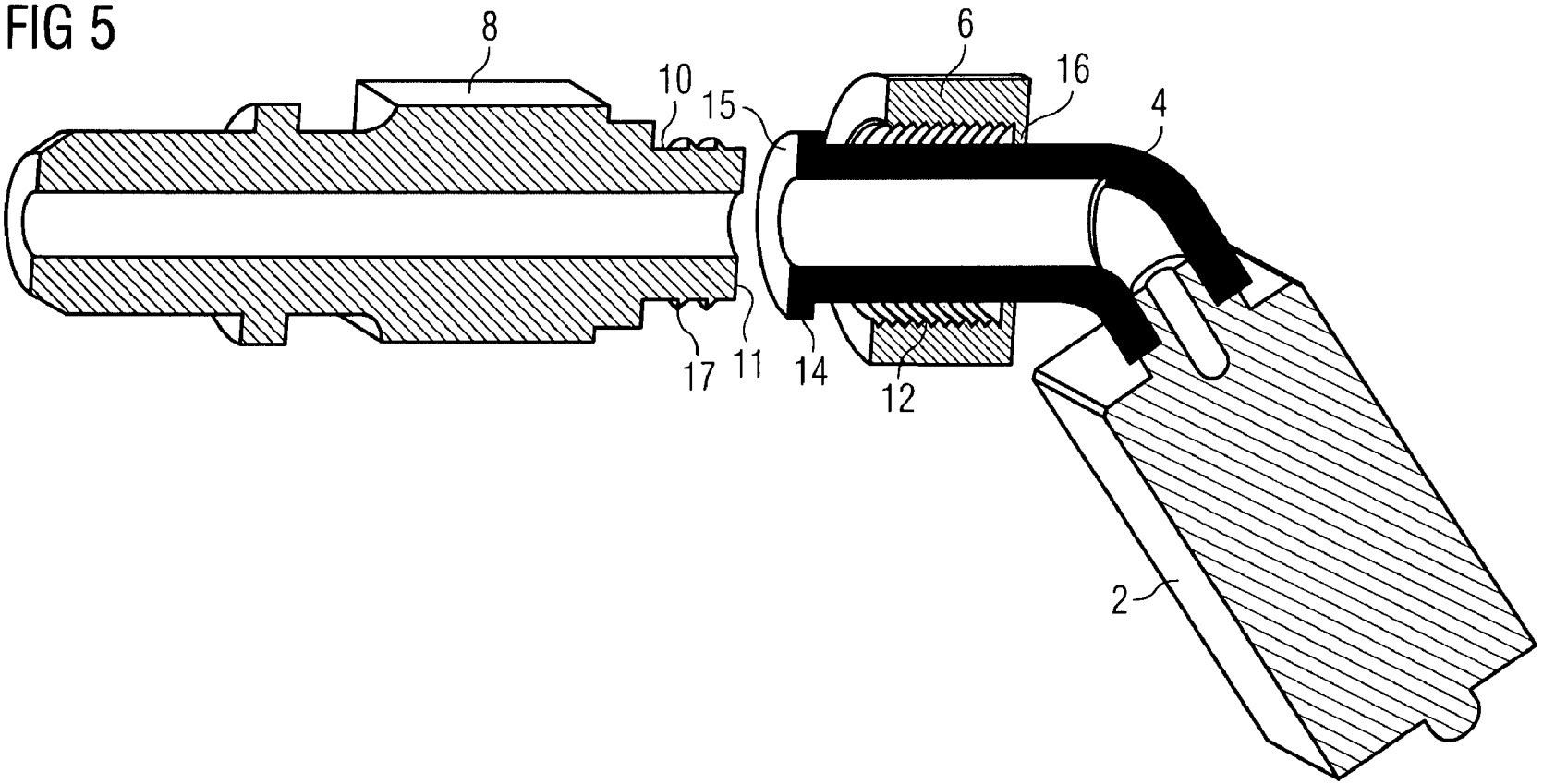
FIG. 5 shows a cross-sectional view of the embodiment in FIG. 3.

A shown in FIGS. 4 and 5 the receiver tube 4 has at least one flanged section 14 at its end, which is embodied in a continuous or at least partially continuous manner. The flanged section 14 here has a contact surface 15, which abuts against a contact surface 11 of the connector piece 8, when this is connected to the receiver tube 4 by way of the connecting element 6. The contact surface 15 of the flanged section 14 can hereby be selected so that it is for example identical to or smaller than the contact surface 11 of the connector piece 8 and therefore does not project beyond the contact surface 11 of the connector piece 8. The contact surface 15 is hereby selected so that an adequate seal is ensured between the connector piece 8 and the receiver tube 4.

The contact surface 15 of the flanged section 14 can also be selected so that it is greater than the contact surface 11 of the end section 10 or projects beyond it. The size of the contact surface 15 of the flanged section 14 in this instance is however designed so that the flanged section 14 is not pushed between the threads 12, 17 of the connecting element 6 and the connector piece 8 during securing. In other words in the secured state the contact surface 15 of the flanged section 14 only encloses at least part of an initial section of the connector piece 8, which has no thread. With the embodiments described above for the configuration of the contact surface 15 of the flanged section 14, the flanged section 14 is prevented from being pushed between the threads 12, 17 of the connecting element 6 and connector piece 8, when these are screwed into place. The contact surface 15 of the flanged section 14 and the corresponding contact surface 11 of the connector piece 8 are selected so that an adequate seal is provided, when the receiver tube 4 is secured to the connector piece 8.

Also at least one flanged section 16 is provided on the inner periphery of the connecting element 6, being embodied in a continuous or at least partially continuous manner.

During securing of the connecting element 6, this is first pushed over the receiver tube 4, with the contact surfaces 11, 15 of the connector piece 8 and receiver tube 4 abutting against each other, while the connecting element 6 is screwed onto the connector piece 8 or its end section 10.

When the connecting element 6 is screwed completely to the connector piece 8, the end section 10 of the connector piece 8 preferably abuts against the flanged section 14 of the receiver tube 4 or is pushed and/or pressed against this. The flanged section 14 of the receiver tube 4 then abuts against the rear flanged section 16 of the connecting element 6 or is pushed and/or pressed against this.

This has the advantage that a seal is produced between the connector piece 8 and the receiver tube 4 and the flanged sections 14, 16 of the receiver tube 4 and the connecting element 6. This allows a connection that is essentially acoustically sealed and/or airtight up to 100% to be achieved. Therefore an acoustic signal generated by the receiver facility 2 cannot escape through the connection in an unwanted manner. This allows acoustic feedback to be effectively prevented.

Figure 6A:
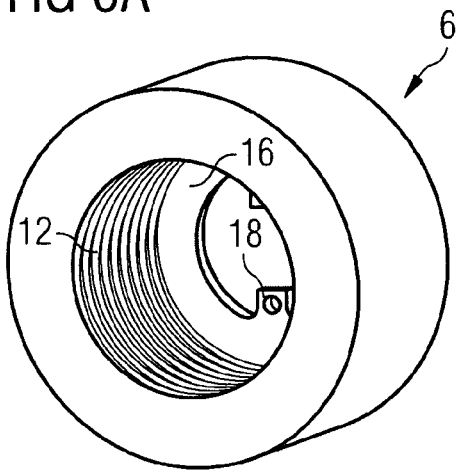
FIG. 6*a* shows a front view and FIG. 6*b* shows a rear view of a second embodiment of the connecting element in FIGS. 4 and 5, and FIGS. 7*a* and 7*b* show a second and third embodiment of the connecting element.
Figure 6B:
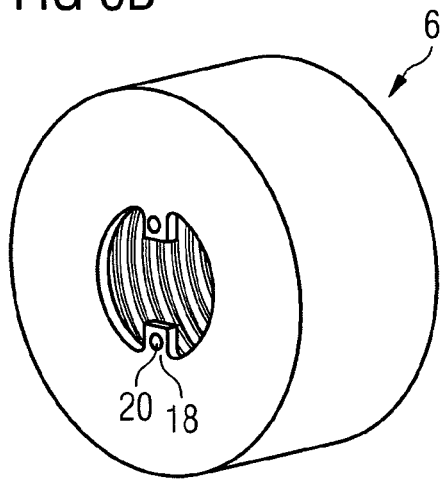

In one embodiment of the invention, as shown in FIGS. 6*a* and 6*b*, the connecting element 6 can also have at least one tongue 18 with an opening 20 for securing purposes.

The opening 20 serves to secure a suitable tool thereto, to hold and/or rotate the connecting element 6 during screwing. This has the advantage that the connecting element 6 can be tightened more easily, so that with the embodiments described above the end section 10 of the connector piece 8 can be drawn securely against the flanged section 16 of the connecting element 6 and the receiver flange 14 can be clamped and/or pressed in between.

Figure 7A:
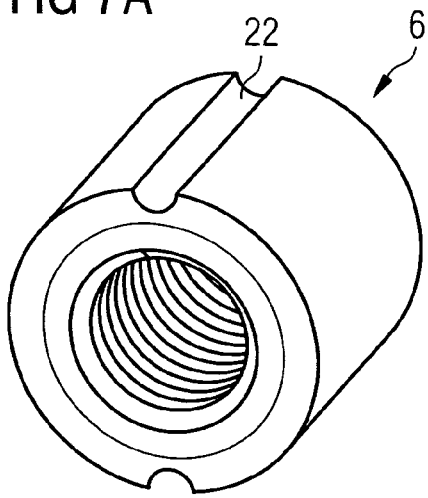
Figure 7B:
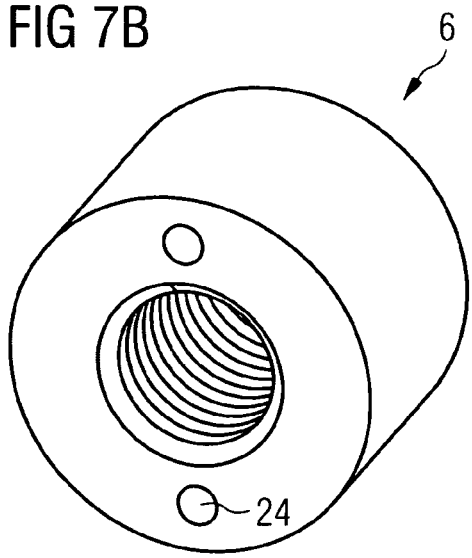

As an alternative to holding a corresponding tool, the connecting element 6 can for example also have grooves 22, as shown in FIG. 7*a*. In another alternative embodiment the connecting element 6 is provided with holes 24, as shown in FIG. 7*b*.

Figure 2:
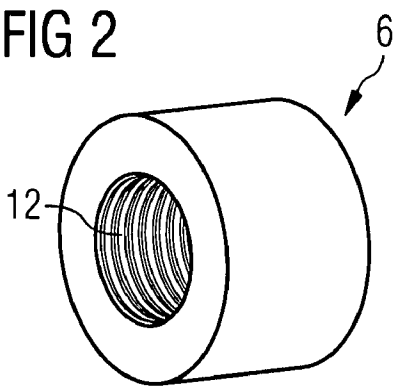
FIG. 2 shows a front view of a first inventive embodiment of a connecting element.

The inventive embodiments described above are also not limited to the connection of the receiver tube 4 go a connector piece 8 of the housing. Optionally or additionally a receiver connector (receiver union) and the receiver tube can also be connected correspondingly. To this end the receiver connector can have a corresponding thread and the receiver tube 4 can be provided with the connecting element 6. As described above in detail with reference to FIGS. 5 to 7, the connecting element can be embodied as a separate part, which can be disposed on the receiver tube in a movable manner. Alternatively the receiver tube 4 can also be molded onto the connecting element 6, as described with reference to FIGS. 1 to 3.

The inventive hearing device includes hearing devices for people with hearing problems, such as hearing impairment, as well as any other type of hearing devices and/or hearing aids, which are used to transmit acoustic signals. These include for example so-called headsets, as used with mobile phones.

The invention claimed is:

1. A hearing device, comprising:

a receiver;

a receiver tube associated with the receiver;

a connector piece; and an intermediate connecting element configured to connect the receiver tube to the connector piece;

wherein the connector piece comprises a first flanged section comprising a first contact surface;

wherein the receiver tube comprises a second flanged section comprising a second contact surface; and wherein the intermediate connecting element is configured to push the second flanged surface of the receiver tube against the first flanged section of the connector piece such that the second contact surface of the receiver tube abuts against the first contact surface of the connector piece.

2. The hearing device as claimed in claim 1, wherein the intermediate connecting element and the connector piece each comprise a threaded section and the connector piece is secured to the receiver tube by the threaded sections.

3. The hearing device as claimed in claim 1, wherein the receiver tube is molded onto the intermediate connecting element at an end of the connecting element.

4. The hearing device as claimed in claim 3, wherein the receiver tube is molded to the intermediate connecting element by an injection molding method.

5. The hearing device as claimed in claim 1, wherein the intermediate connecting element is laterally movable on the receiver tube.

6. The hearing device as claimed in claim 1, wherein the first flanged section is continuous or at least partially continuous.

7. The hearing device as claimed in claim 1, wherein the second flanged section is continuous or at least partially continuous.

8. The hearing device as claimed in claim 1, wherein the first and the second contact surface is selected for achieving a seal.

9. The hearing device as claimed in claim 8, wherein the second contact surface of the receiver tube is identical to or smaller than the first contact surface of the connector piece.

10. The hearing device as claimed in claim 8, wherein the second contact surface of the receiver tube projects beyond the first contact surface of the connector piece and covers at least part of an end section of the connector piece.

11. The hearing device as claimed in claim 10, wherein the end section of the connector piece has no thread.

12. The hearing device as claimed in claim 1, wherein the hearing device is a behind the ear hearing device and the connector piece is a separate part that connects a housing of the hearing device to a carrier hook.

13. The hearing device as claimed in claim 1, wherein the hearing device is an in the ear hearing device and the connector piece is an acoustic output of a housing of the hearing device and is a single piece with the housing or an insert secured in the housing.

14. A method for connecting a receiver tube in a hearing device, comprising:

connecting a receiver of the hearing device with the receiver tube;

associating an intermediate connecting element with the receiver tube; and acoustically sealedly connecting the receiver tube to a connector piece of the hearing device by the intermediate connecting element;

wherein the acoustically sealedly connecting comprises pushing a second flanged section of the receiver tube against a first flanged section of the connector piece using the intermediate connecting element such that a second contact surface of the receiver tube abuts against a first contact surface of the connector piece.

15. The hearing device as claimed in claim 9, wherein the second contact surface of the receiver tube is identical in size to the first contact surface of the connector piece.

16. The hearing device as claimed in claim 1, wherein the intermediate connecting element comprises a tongue having an opening therein, the tongue extending from a rear portion of the intermediate coupling element.

* * * * *